US006385980B1

(12) United States Patent
Sienel

(10) Patent No.: US 6,385,980 B1
(45) Date of Patent: May 14, 2002

(54) HIGH PRESSURE REGULATION IN ECONOMIZED VAPOR COMPRESSION CYCLES

(75) Inventor: Tobias H. Sienel, Manchester, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/713,090

(22) Filed: Nov. 15, 2000

(51) Int. Cl.[7] ..... F25B 41/00
(52) U.S. Cl. ..... 62/174; 62/509
(58) Field of Search ..... 62/174, 509

(56) References Cited

U.S. PATENT DOCUMENTS 5,174,123 A * 12/1992 Erickson ..... 62/113
5,245,836 A * 9/1993 Lorentzen et al. ..... 62/174
5,431,026 A * 7/1995 Jaster ..... 62/509
5,692,389 A * 12/1997 Lord et al. ..... 62/222
5,829,262 A * 11/1998 Urata et al. ..... 62/174
6,073,454 A * 6/2000 Spauschus et al. ..... 62/114

FOREIGN PATENT DOCUMENTS

JP 08-174157 1/1998
WO WO99/08053 2/1999

* cited by examiner

*Primary Examiner*—William E. Tapolcai
*Assistant Examiner*—Mohammad M Ali
(74) *Attorney, Agent, or Firm*—Carlson Gaskey & Olds

(57) ABSTRACT

A flash tank employing valves for use in transcritical cycles of a vapor compression system to increase the efficiency and/or capacity of the system. Carbon dioxide is preferably used as the refrigerant. The high pressure of the system (gas cooler pressure) is regulated by controlling the amount of charge in the flash tank by actuating valves positioned on the expansion devices located at the entry and exit of the flash tank. If the pressure in the gas cooler is too high or too low, the valves can be adjusted to either store charge in or release charge from the flash tank. By regulating the amount of charge in the flash tank, the high pressure of the system can be controlled to achieve optimal efficiency and/or capacity.

24 Claims, 3 Drawing Sheets

HIGH PRESSURE REGULATION IN ECONOMIZED VAPOR COMPRESSION CYCLES

BACKGROUND OF THE INVENTION

The present invention relates generally to a means for regulating the high pressure component of a transcritical vapor compression system.

Chlorine containing refrigerants have been phased out in most of the world due to their ozone destroying potential. Hydrofluoro carbons (HFCs) have been used as replacement refrigerants, but these refrigerants still have high global warming potential. "Natural" refrigerants, such as carbon dioxide and propane, have been proposed as replacement fluids. Unfortunately, there are problems with the use of many of these fluids as well. Carbon dioxide has a low critical point, which causes most air conditioning systems utilizing carbon dioxide as a refrigerant to run transcritical under most conditions.

When a vapor compression system is run transcritical, it is advantageous to regulate the high pressure component of the system. By regulating the high pressure of the system, the capacity and/or efficiency of the system can be controlled and optimized. Increasing the high pressure of the system (gas cooler pressure) lowers the specific enthalpy entering the evaporator and increases capacity. However, more energy is expended because the compressor must work harder. It is advantageous to find the optimal high pressure of the system, which changes as operating conditions change. By regulating the high pressure component of the system, the optimal high pressure can be selected. Hence, there is a need in the art for a means for regulating the high pressure component of a transcritical vapor compression system.

SUMMARY OF THE INVENTION

The present invention relates to a means for regulating the high pressure component of a transcritical vapor compression system.

A vapor compression system consists of a compressor, a gas cooler, an expansion device, and an evaporator. Economizer cycles are sometimes employed to increase the efficiency and/or capacity of the system. Economizer cycles operate by expanding the refrigerant leaving the heat rejecting heat exchanger to an intermediate pressure and separating the refrigerant flow into two streams. One stream is sent to the heat absorbing heat exchanger, and the other is sent to cool the flow between two compression stages. In one form of an economizer cycle, a flash tank is used to perform the separation. This invention regulates the high pressure component of the vapor compression system (pressure in the gas cooler) by controlling the amount of charge in the flash tank. In a preferred embodiment of the invention, carbon dioxide is used as the refrigerant.

In a flash tank, refrigerant discharged from the gas cooler passes through a first expansion device, and its pressure is reduced. The refrigerant collects in the flash tank as part liquid and part vapor. The vapor refrigerant is used to cool refrigerant exhaust as it exits a first compression device, and the liquid refrigerant is further expanded by a second expansion device before entering the evaporator.

Expansion valves positioned on the path leading into and out of the flash tank are used to expand the refrigerant from high pressure to low pressure. This invention controls the actuation of the expansion valves to control the flow of charge into and out of the flash tank, regulating the amount of charge stored in the flash tank. By regulating the amount of charge stored in the flash tank, the amount of charge in the gas cooler and the high pressure of the system can be controlled.

An optimal pressure of the system can be selected by controlling the actuation of the valves. If the pressure in the gas cooler is too low, the expansion valves can be adjusted to release charge from the flash tank into the system to increase the gas cooler pressure, increasing the capacity of the system. If the pressure in the gas cooler is too high, the expansion valves can be adjusted to store charge in the flash tank to decrease the gas cooler pressure, reducing the energy expended by the compressor.

Accordingly, the present invention provides a method and system for regulating the high pressure component of a transcritical vapor compression system.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
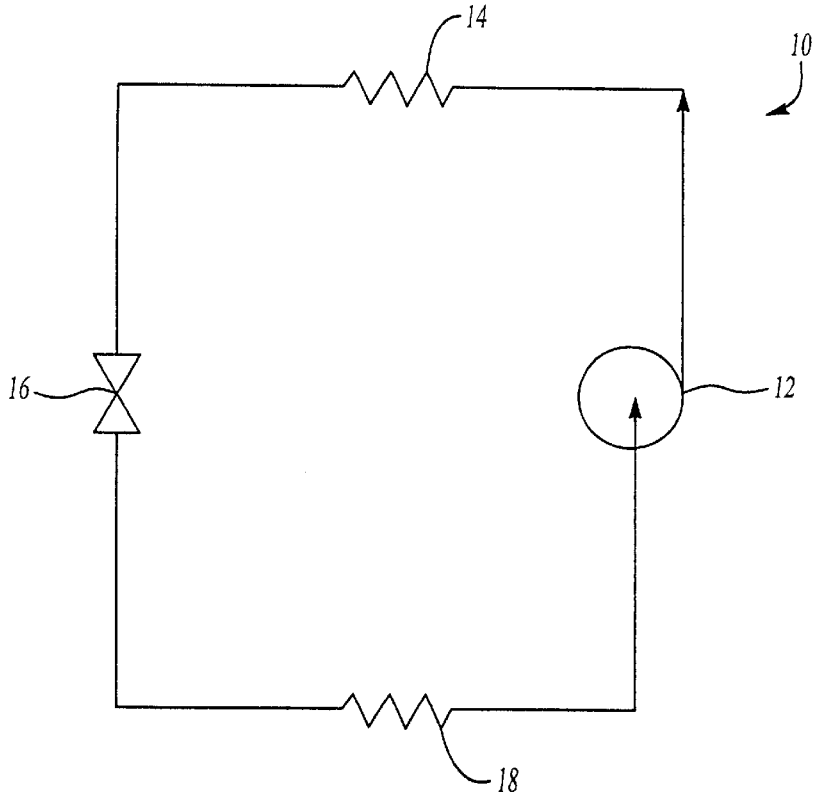
Fig-1 PRIOR ART
FIG. 1 illustrates a schematic diagram of a prior art vapor compression system.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

FIG. 1 illustrates a prior art vapor compression system 10. A basic vapor compression system 10 consists of a compressor 12, a heat rejecting heat exchanger (a gas cooler in transcritical cycles) 14, an expansion device 16, and a heat accepting heat exchanger (an evaporator) 18.

Refrigerant is circulated though the closed circuit cycle 10. In preferred embodiments of the invention, carbon dioxide is used as the refrigerant. While carbon dioxide is illustrated, other refrigerants may be used. Because carbon dioxide has a low critical point, systems utilizing carbon dioxide as a refrigerant usually require the vapor compression system 10 to run transcritical.

When the system 10 is run transcritical, it is advantageous to regulate the high pressure component of the vapor compression system 10. By regulating the high pressure of the system 10, the capacity and/or efficiency of the system 10 can be controlled and optimized. Increasing the gas cooler 14 pressure lowers the enthalpy entering the evaporator 18 and increases capacity, but also requires more energy because the compressor 16 must work harder. By regulating the high pressure of the system 10, the optimal pressure of the system 10, which changes as the operating conditions change, can be selected.

Figure 2:
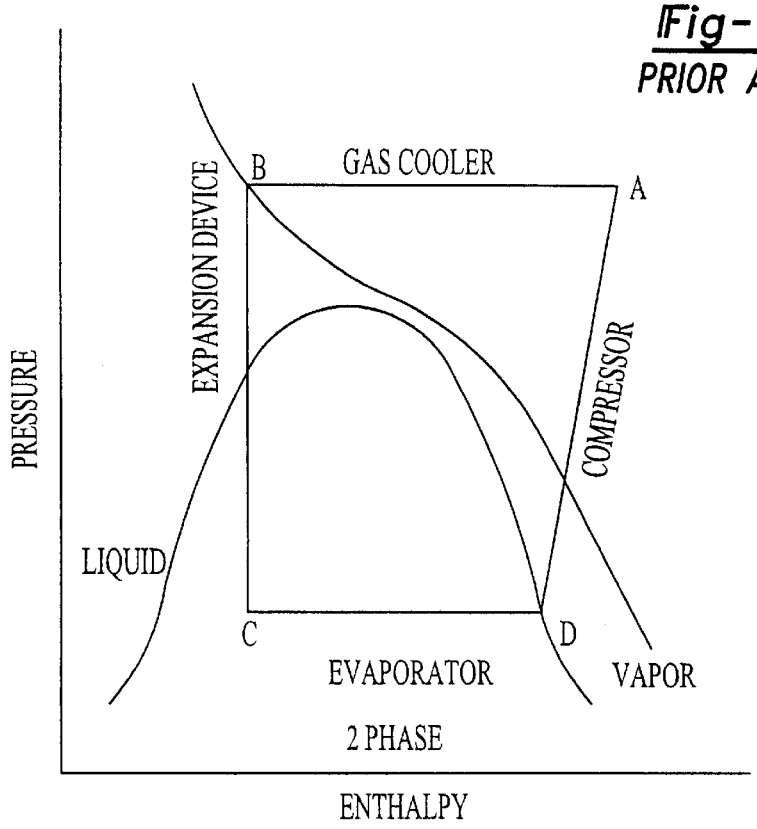
FIG. 2 illustrates a thermodynamic diagram of a transcritical vapor compression system.

In a cycle of a prior art vapor compression system 10 illustrated in FIG. 1, the refrigerant exits the compressor 12 at high pressure and enthalpy, shown by point A in FIG. 2. As the refrigerant flows through the gas cooler 14 at high pressure, it loses heat and enthalpy, exiting the gas cooler 14 with low enthalpy and high pressure, indicated as point B. As the refrigerant passes through the expansion device 16, the pressure of the refrigerant drops, shown by point C. After expansion, the refrigerant passes through the evaporator 18 and exits at a high enthalpy and low pressure, represented by point D. After the refrigerant passes through the compressor 12, it is again at high pressure and enthalpy, completing the cycle.

Figure 3:
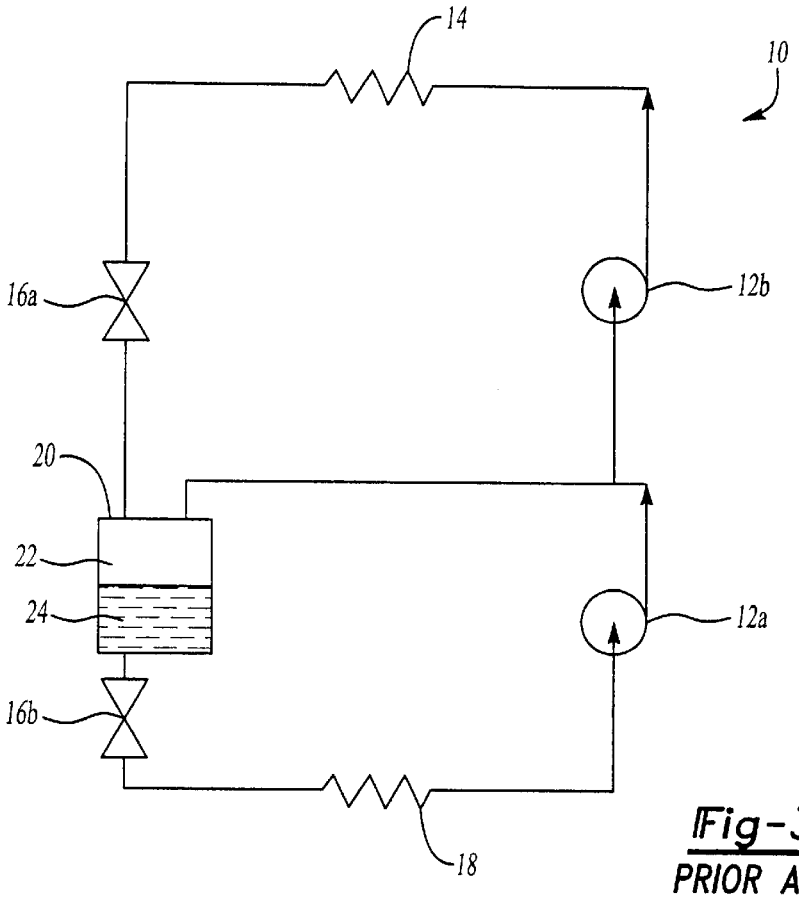
Fig-3 PRIOR ART
FIG. 3 illustrates a schematic diagram of a prior art two stage vapor compression system utilizing a flash tank.

FIG. 3 illustrates a vapor compression system 10 employing a flash tank 20 in a two stage economized cycle. The refrigerant exiting the gas cooler 14 is passed through a first expansion device 16*a*, reducing its pressure. The refrigerant collects in a flash tank 20 as part liquid 24 and part vapor 22. The structure of the flash tank 20 is known and forms no part of this invention. The flash tank 20 is controlled in an inventive way in the invention of this application. The vapor 22 is drawn at the top of the flash tank 20 and is used to cool refrigerant that exits the first compression device 12*a*. The liquid refrigerant 24 collects at the bottom of the flash tank 20 and is again expanded by a second expansion device 16*b* before entering the evaporator 18. After the refrigerant passes through the evaporator 18, it is compressed by the first compression device 12*a*, the exhaust being cooled by the cool refrigerant vapor discharged 22 from the flash tank 20. The refrigerant is then compressed again by a second compression device 12*b* before entering the gas cooler 14. By using the flash tank 20, the specific enthalpy of the system can be reduced, which increases the capacity of the system 10. However, the flash tank 20 has no effect on the high pressure in the gas cooler 14, which would allow for more control over the high pressure of the system 10.

Figure 4:
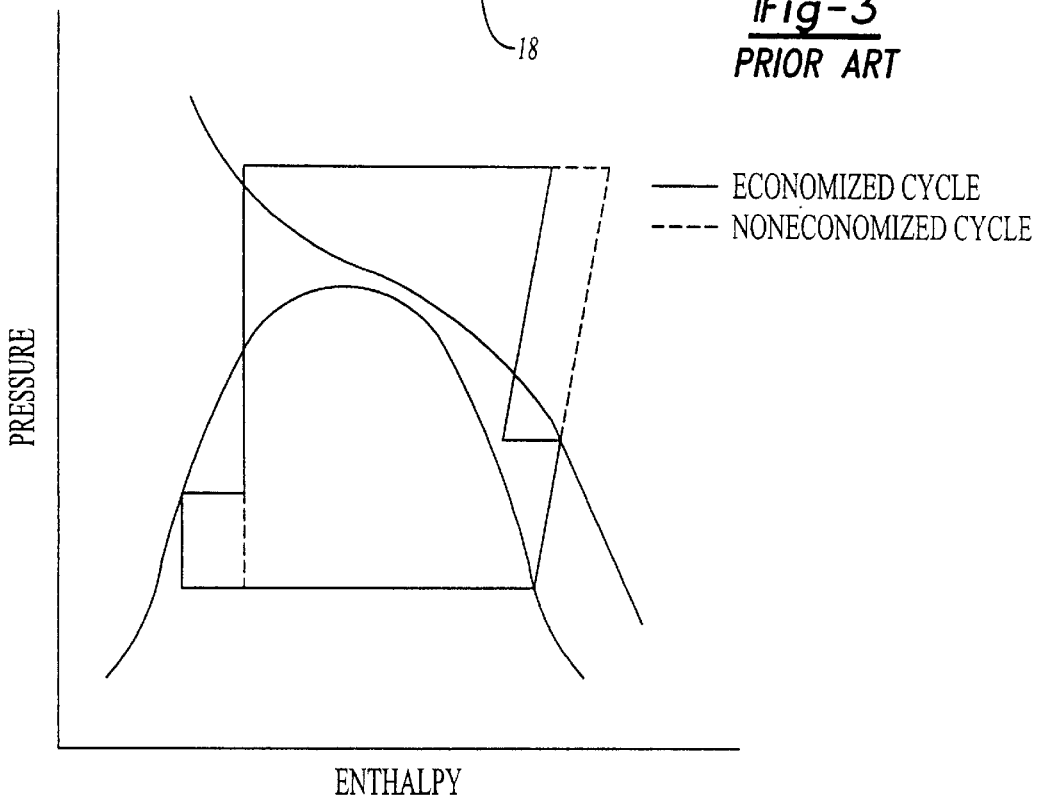
FIG. 4 illustrates a thermodynamic diagram of a two stage economized cycle and a noneconomized cycle of a transcritical vapor compression cycle.

By utilizing multistage compression, the efficiency of the economized system 10 can be increased where there is a large difference between the high and low pressures in a system. As known, a line 23 communicate vapor 22 to the suction part of the compression stage 12*b*. This provides cooling, and is known as economized operation. A thermodynamic diagram of both an economized cycle and a non-economized cycle is illustrated in FIG. 4. Economization allows for greater more mass flow through the gas cooler 14, and reduces the specific enthalpy of the refrigerant that enters the evaporator 18, causing the cycle to have greater cooling capacity.

Figure 5:
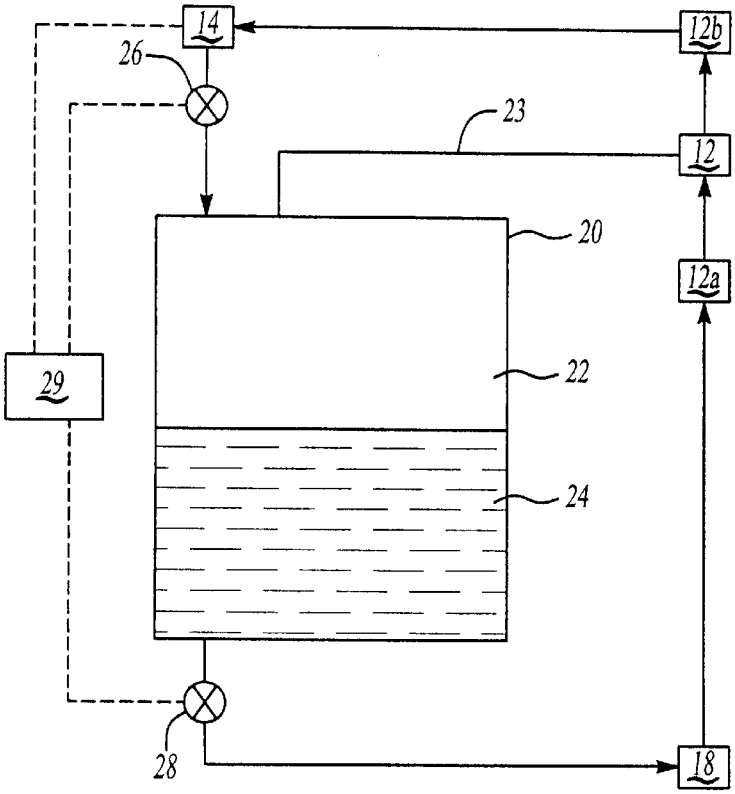
FIG. 5 illustrates a schematic diagram of a flash tank of a two stage vapor compression system utilizing expansion valves to control the high pressure of the system.

FIG. 5 illustrates a flash tank 20 and expansion valves 26, 28 utilized to regulate the high pressure in a transcritical cycle. A first expansion valve 26 regulates the flow of charge into the flash tank 20 and a second expansion valve 28 regulates the flow of charge out of the flash tank 20.

As known, the flow rate of the charge through the first expansion valve 26 and the second expansion valve 28 is a function of the pressure in the system 10 and the diameter of an orifice in the expansion valves 26, 28. The expansion valves 26, 28 are actuated by increasing or decreasing the size of the orifice. By opening or increasing the size of the orifice in the expansion valves 26, 28, the flow rate of charge through the expansion valves 26, 28 can be increased. In contrast, by closing or decreasing the size of the orifice in the expansion valves 26, 28, the flow rate of charge through the expansion valves 26, 28 can be decreased. By controlling the flow rate of charge though the expansion valves 26, 28, the amount of charge in the flash tank 20, and the gas cooler 14, can be regulated to control the pressure in the gas cooler 14.

Control 29 monitors the pressure in the cooler 14 and controls expansion valves 26 and 28. The control 29 may be the main control for cycle 10. Control 29 is programmed to evaluate the state the cycle 10 and determine a desired pressure in cooler 14. Once a desired pressure has been determined, the expansion valves 26 and 28 are controlled to regulate the pressure. The factors that would be used to determine the optimum pressure are within the skill of a worker in the art.

If the pressure in the gas cooler 14 is above the optimal pressure, a large amount of energy is used to compress the refrigerant. Control 29 actuates the second expansion valve 28 to close and reduce the volume flow of charge out of the flash tank 20, increasing the amount of charge in the flash tank 20, decreasing both the amount of charge and the pressure in the gas cooler 14. Conversely, if the pressure in the gas cooler 14 pressure is below the optimal pressure, the efficiency of the system 10 could be increased. Control 29 closes the first expansion valve 26 to decrease the volume flow of charge into the flash tank 20, increasing both the amount of charge and the pressure in the gas cooler 14.

The pressure in the gas cooler 14 is monitored by controller 29. As the pressure in the gas cooler 14 changes, the controller 29 adjusts the actuation of the expansion valves 26, 28 so the optimal pressure can be achieved.

By selectively controlling the actuation of the first expansion valve 26 and the second expansion valve 28, the amount of charge stored in the flash tank 20 can be varied, which varies the high pressure component in the system 10 to achieve optimal capacity and/or efficiency. By regulating the high pressure in the gas cooler 14 before expansion, the enthalpy of the refrigerant at the entry of the evaporator can be modified, controlling the capacity and/or efficiency of the system 10.

While the simplest way to visualize the invention control 29 is to close valve 26 to decrease volume in the flash tank 20 and close valve 28 to increase volume, valve 26 can be opened to increase flow and valve 28 can be opened to decrease volume.

Figure 6:
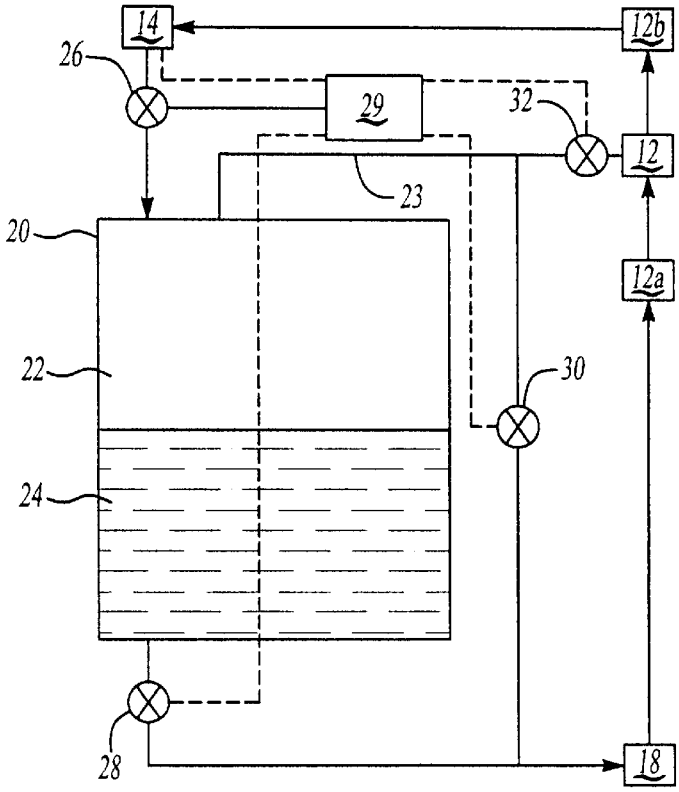
FIG. 6 illustrates a schematic diagram of a two stage flash tank of a vapor compression system utilizing additional valves to control the high pressure of the system.

As shown in FIG. 6, a third valve 30 and a fourth valve 32 can also be employed to vary the charge level in the flash tank 20 and optimize efficiency and/or capacity of the system 10. The fourth valve 32 controls the flow of charge from the flash tank 20 to the compression device 12. By closing the fourth valve 32, the economizer is turned off and the vapor refrigerant 22 exiting the flash tank 20 is blocked from entering the compressor 12. Closing the fourth valve 32 traps the vapor refrigerant 20 in the flash tank 20. The third valve 30 acts as a release and opening the third valve 30 allows the flow of charge from the flash tank 20 to the evaporator 18. By opening the third valve 30, the vapor refrigerant 22 from the flash tank 20 is allowed to enter the evaporator 18, creating and escape for the vapor 22. Alternatively, the fourth valve 32 can be opened to turn on the economizer. By controlling valves 30 and 32, the economizer can be turned on and off to optimize the efficiency of the system 10. The actuation of valves 30, 32 is also controlled by the controller 29 which monitors the pressure in the gas cooler 14.

Accordingly, the present invention provides a flash tank 20 utilizing expansion valves 26, 28 to control the high pressure in a transcritical vapor compression system 10.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. An apparatus for regulating a high pressure of a refrigerant circulating in a transcritical vapor compression system comprising:

a flash tank positioned between a first expansion valve and a second expansion valve for storing an amount of charge, a path leading from said flash tank to an inner compression stage between a first compression device and a second compression device;

said first expansion valve regulating flow of said charge into said flash tank and regulating an amount of charge in said flash tank, said first expansion valve actuated by a controller monitoring said high pressure; and a second expansion valve regulating flow of said charge out of said flash tank and regulating an amount of charge in said flash tank, said second expansion valve actuated by said controller monitoring said high pressure.

2. The apparatus as recited in claim 1 wherein said high pressure is regulated by actuating said first expansion valve and said second expansion valve to control said amount of charge in said flash tank.

3. The apparatus as recited in claim 2 wherein said valves are controlled to decrease said charge in said flash tank and to increase said high pressure of said refrigerant.

4. The apparatus as recited in claim 2 wherein said valves are controlled to increase said charge in said flash tank and to decrease said high pressure of said refrigerant.

5. The apparatus as recited in claim 1 wherein said charge is stored in said flash tank to decrease said high pressure of said refrigerant.

6. The apparatus as recited in claim 1 wherein said charge is released from said flash tank to increase said high pressure of said refrigerant.

7. The apparatus as recited in claim 1 wherein said refrigerant is carbon dioxide.

8. A transcritical vapor compression system comprising:

a dual compression device having a first compression device and a second compression device and an inner compression stage between said first compression device and said second compression device, said dual compression device compressing a refrigerant to a high pressure;

a heat rejecting heat exchanger for cooling said refrigerant;

a dual expansion device having a first expansion valve and a second expansion device, said dual expansion device reducing said refrigerant to a low pressure;

a heat accepting heat exchanger for evaporating said refrigerant; and a flash tank for regulating said high pressure of said system positioned between said first expansion valve and said second expansion valve and having a path leading to said inner compression stage, said first expansion valve regulating flow of said charge into said flash tank, said second expansion valve regulating flow of said charge out of said flash tank, said first expansion valve and said second expansion valve actuated to regulate said high pressure by regulating said amount of charge in said flash tank.

9. The system as recited in claim 8 wherein said high pressure is regulated by actuating said first expansion valve and said second expansion valve to control said amount of charge in said flash tank.

10. The system as recited in claim 8 wherein said charge is stored in said flash tank decrease said high pressure of said refrigerant.

11. The system as recited in claim 8 wherein said charge is released from said flash tank to increase said high pressure of said refrigerant.

12. The system as recited in claim 8 wherein said refrigerant is carbon dioxide.

13. A method of regulation of a high pressure of a transcritical vapor compression system by regulating an amount of charge in a flash tank, the method comprising the steps of:

compressing a refrigerant in two stages of compression to said high pressure;

cooling said refrigerant;

expanding said refrigerant in two stages to a low pressure;

evaporating said refrigerant; and controlling said high pressure of said refrigerant by passing said refrigerant through a flash tank positioned between stages of expansion, an amount of said charge in said flash tank controlled by a first expansion valve regulating flow of said charge into said flash tank, and a second expansion valve regulating flow of said charge out of said flash tank.

14. The method as recited in claim 13 wherein the step of controlling said high pressure comprises actuating said first expansion valve and said second expansion valve to regulate said amount of charge in said storage tank.

15. The method as recited in claim 13 wherein the refrigerant is carbon dioxide.

16. An apparatus for regulating a high pressure of a refrigerant circulating in a transcritical vapor compression system comprising:

a flash tank positioned between a first expansion valve and a second expansion valve, said flash tank storing an amount of charge;

said first expansion valve regulating flow of said charge into said flash tank and regulating an amount of charge in said flash tank, said first expansion valve actuated by a controller monitoring said high pressure;

a second expansion valve regulating flow of said charge out of said flash tank and regulating an amount of charge in said flash tank, said second expansion valve actuated by said controller monitoring said high pressure;

a third valve positioned to regulate flow of said charge from said flash tank to a heat accepting heat exchanger; and a fourth valve positioned to regulate flow of said charge from said flash tank to a compression device, said third valve and said fourth valve actuated by said controller monitoring said high pressure.

17. The apparatus as recited in claim 1 wherein said path communicates a refrigerant vapor in said flash tank to said inner compression stage.

18. The apparatus as recited in claim 1 wherein said controller monitors said high pressure in a heat rejecting heat exchanger.

19. The system as recited in claim 8 wherein said first expansion valve and said second expansion valve are actuated by a controller monitoring said high pressure.

20. The system as recited in claim 19 wherein said controller monitors said high pressure in a heat rejecting heat exchanger.

21. The method as recited in claim 13 further comprising the step of monitoring said high pressure of said transcritical vapor compression system.

22. The method As recited in claim 21 wherein the step of monitoring said high pressure of said transcritical vapor compression system includes monitoring said high pressure in a heat rejecting heat exchanger.

23. A transcritical vapor compression system comprising:

a dual compression device having a first compression device and a second compression device and an inner compression stage between said first compression device and said second compression device, said dual compression device compressing a refrigerant to a high pressure;

a heat rejecting heat exchanger for cooling said refrigerant;

a dual expansion device having a first expansion valve and a second expansion device, said dual expansion device reducing said refrigerant to a low pressure;

a heat accepting heat exchanger for evaporating said refrigerant;

a flash tank for regulating said high pressure of said system positioned between said first expansion valve and said second expansion valve and having a path leading to said inner compression stage, said first expansion valve regulating flow of said charge into said flash tank, said second expansion valve regulating flow of said charge out of said flash tank said first expansion valve and said second expansion valve actuated to regulate said high pressure by regulating said amount of charge in said flash tank;

a third valve positioned to regulate flow of said charge from said flash tank to said heat accepting heat exchanger; and a fourth valve positioned to regulate flow of said charge from said flash tank to said intermediate compression stage of said dual compression device, said third valve and said fourth valve actuated by said controller monitoring said high pressure.

24. The method as recited in claim 13 wherein said amount of said charge in said flash tank is further controlled by a third valve positioned to regulate flow of said charge from said flash tank to the step of evaporating and a fourth valve positioned to regulate flow of said charge from said flash tank to the step of compression.

* * * * *

UNITED STATES PATENT AND TRADEMARK OFFICE

CERTIFICATE OF CORRECTION

PATENT NO. : 6,385,980 B1
DATED : May 14, 2002
INVENTOR(S) : Sienel

It is certified that error appears in the above-identified patent and that said Letters Patent is hereby corrected as shown below:

Column 6,
Line 18, add -- to -- before "decrease"

Column 7,
Line 18, "As" should be -- as --

Signed and Sealed this

Nineteenth Day of November, 2002

*Attest:*

*Attesting Officer*

JAMES E. ROGAN
*Director of the United States Patent and Trademark Office*